US005507468A

United States Patent [19]

Evans

[11] Patent Number: 5,507,468

[45] Date of Patent: Apr. 16, 1996

[54] INTEGRAL BI-DIRECTIONAL FLOW CONTROL VALVE

[75] Inventor: Robert J. Evans, Fort Wayne, Ind.

[73] Assignee: Aeroquip Corporation, Maumee, Ohio

[21] Appl. No.: 371,834

[22] Filed: Jan. 12, 1995

[51] Int. Cl.[6] ..... F25B 13/00

[52] U.S. Cl. ..... 251/118; 137/513.3; 62/222; 62/324.6; 62/527

[58] Field of Search ..... 251/118; 138/43, 138/44; 62/511, 324.6, 527, 222; 137/493, 493.8, 493.9, 513.3, 513.7, 614.2, 545

[56] References Cited

U.S. PATENT DOCUMENTS

| | | |
|---|---|---|
| 1,162,319 | 11/1915 | Southworth . |
| 3,805,825 | 4/1974 | Lovingham . |
| 3,992,898 | 11/1976 | Duell et al. . |
| 4,009,592 | 3/1977 | Boerger . |
| 4,633,681 | 1/1987 | Webber . |
| 4,653,291 | 3/1987 | Moeller et al. . |
| 4,896,696 | 1/1990 | Bradley et al. . |
| 4,926,658 | 5/1990 | Olsen et al. . |
| 5,038,579 | 8/1991 | Drucker . |
| 5,056,560 | 10/1991 | DeMartelaere . |
| 5,265,438 | 11/1993 | Knowles et al. . |

OTHER PUBLICATIONS

Aeroquip Engineering: FD20 Flow Control Literature, 1 page.

*Primary Examiner*—Kevin Lee

*Attorney, Agent, or Firm*—Emch, Schaffer, Schaub & Porcello Co.

[57] ABSTRACT

The present invention is directed to an integral bi-directional flow control valve. The valve includes a housing that defines a passageway for the flow of a fluid in a first direction and a second direction. The housing defines a phase change chamber in the passageway. A first restrictor having a first bore is positioned in the passageway adjacent the phase change chamber. The bore has a volume less than the volume of the chamber. As the fluid flows through the bore in the first direction into the chamber, the fluid changes from a liquid to a gas as it exits the bore. The gas continues to flow through the passageway. A second restrictor having a second bore is positioned in the passageway adjacent the chamber and opposed to the first restrictor. The second restrictor includes a second bore having a volume less than the volume of the chamber. The second bore can be the same size as the first bore or a different size depending on the application. The fluid changes from a liquid to a gas as the fluid flows through the second bore and the chamber in the second direction.

13 Claims, 5 Drawing Sheets

INTEGRAL BI-DIRECTIONAL FLOW CONTROL VALVE

BACKGROUND OF THE INVENTION

The present invention relates generally to a valve. More specifically, the invention is directed to an integral bi-directional flow control valve that can be used with heating and cooling equipment, such as a heat pump and air conditioning system.

A diagrammatic representation of a prior art heat pump and air conditioning system is shown in FIG. 1. The prior art system 10 includes a compressor 12, an accumulator 14 that contains a liquid refrigerant, and a reversing valve 16. An indoor coil 18 and an outdoor coil 20 are connected to the reversing valve 16 by an indoor coil line 22 and an outdoor coil line 24, respectively. The reversing valve 16 can direct the flow of liquid refrigerant from the accumulator 14 to the indoor and outdoor coils 18 and 20 as shown by the arrows. The direction of the flow of the refrigerant determines whether the system 10 is in a heating or cooling cycle.

As shown in FIG. 1, the indoor coil 18 is in communication with a first line 26 that leads to a first by-pass conduit 28 including a first check valve 30. The first line 26 also leads to a first expansion device 32 and a first filter dryer 34. Likewise, the outdoor coil 20 is in communication with a second line 36 that leads to a second by-pass conduit 38 including a second check valve 40. A second expansion device 42 and a second filter dryer 44 are in communication with the second line 36. A connection line 46 connects first line 26 with second line 36.

In the prior art system 10, the first and second by-pass conduits 28 and 38, first and second check valves 30 and 40 and first and second expansion devices 32 and 42 are all required to change the liquid refrigerant to a gas. It has been found that the inclusion of these parts adds undue cost and complexity to the system.

A heat pump and air conditioning system that includes the present invention is shown in FIG. 2. The new system 48 includes a compressor 12, an accumulator 14, a reversing valve 16, an indoor coil 18, an outdoor coil 20 and lines 22, 24, 26, 36 and 46. As shown in FIG. 2, the integral bi-directional flow control valve 50 of the present invention is in communication with line 26. An optional filter dryer 52 is in communication with line 36. A communication line 46 connects line 36 to the valve 50. As it will be appreciated by those skilled in the art, the present invention replaces the by-pass conduits, check valves and expansion devices of the prior art system 10 as shown in FIG. 1. This reduces the cost and greatly simplifies a heat pump and air conditioning system.

SUMMARY OF THE INVENTION

The present invention is directed to an integral bi-directional flow control valve. The valve includes a housing that defines a passageway for the flow of a fluid in a first direction and second direction. The housing defines a phase change chamber in the passageway.

A first restrictor having a first bore is positioned in the passageway adjacent the phase change chamber. The bore has a volume less than the volume of the chamber. As the fluid flows through the bore in the first direction into the chamber, it changes from a liquid to a gas because of the decrease of pressure on the fluid as it exits the bore. The gas continues to flow through the passageway in the first direction.

A second restrictor having a second bore is positioned in the passageway adjacent the chamber and opposed to the first restrictor. The second restrictor includes a second bore having a volume less than the volume of the chamber. The second bore can be the same size as the first bore or a different size depending on the application. The fluid changes from a liquid to a gas as the fluid flows through the second bore and the chamber in the second direction.

It is the primary object of the present invention to provide a valve that controls the flow of a fluid in a first direction and a second direction.

It is an important object of the present invention to provide a valve that causes a fluid to change phases in a first direction and a second direction as it flows through the valve.

Other objects and advantages of the present invention will become apparent upon a review of the drawings and the following detailed description of the invention,

DETAILED DESCRIPTION OF THE PREFERRED EMBODIMENT

Figure 3:
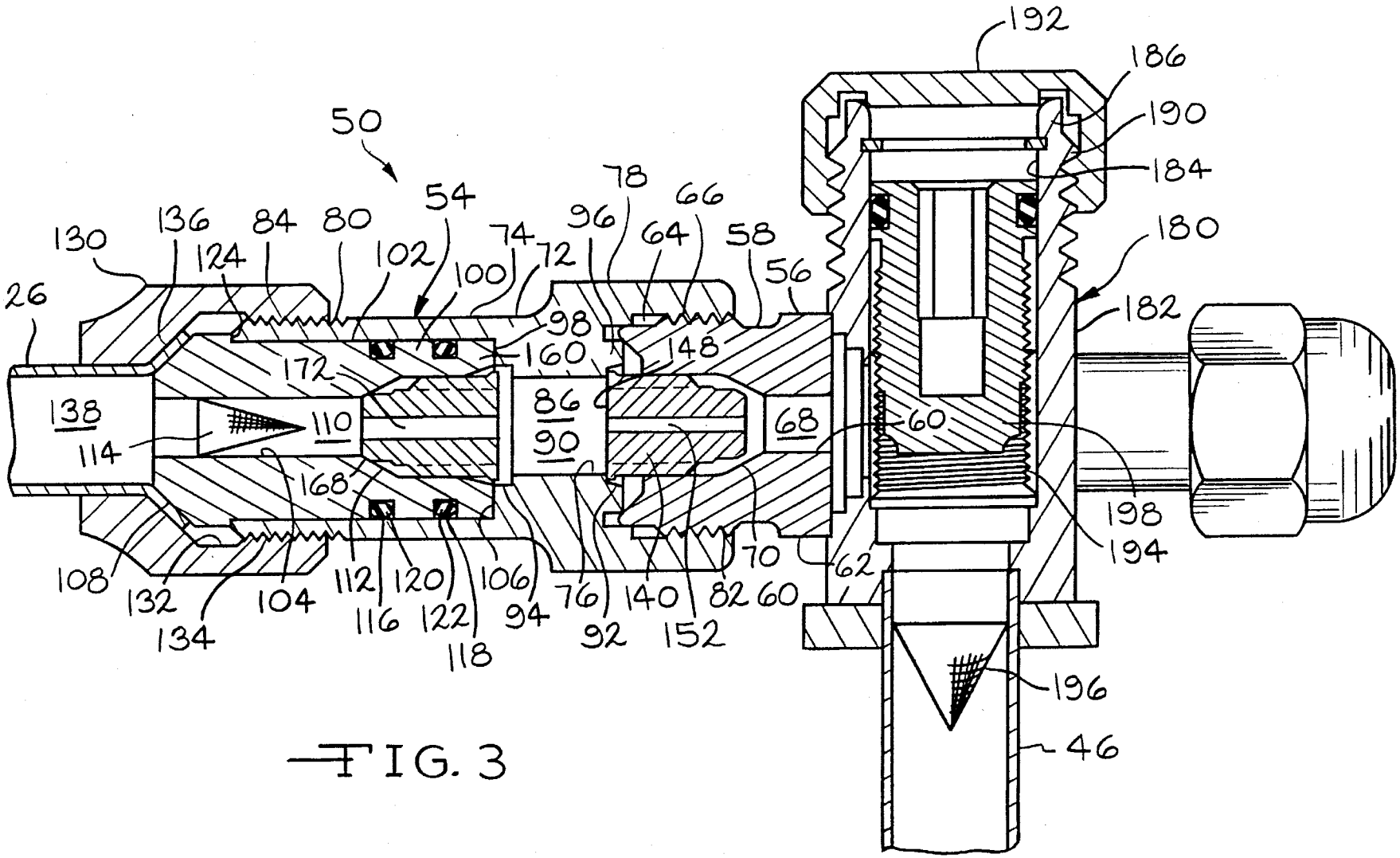
FIG. 3 is a cross-sectional view of the integral bi-directional flow control valve of the present invention with first and second restrictors in position for fluid flow in a first direction.

The present invention will now be described in detail with reference to the accompanying drawings. Referring to FIG. 3, the integral bi-directional flow control valve of the present invention is indicated by the reference number 50. The valve 50 includes a multi-part housing 54 having a first restrictor member 56. The member 56 has an exterior surface 58, an interior surface 60, a first end 62 and a second end 64.

The exterior surface 58 includes radially extending threads 66 at the second end 64. The interior surface 60 defines a first passageway 68 extending longitudinally from the first end 62 to the second end 64. As shown in the embodiment of FIG. 3, the first passageway 68 increases in size from the first end 62 to the second end 64, and can include a first tapered portion 70.

Referring still to FIG. 3, the housing 54 further includes a phase change chamber member 72 that has an outside surface 74, an inside surface 76, a first attachment end 78 and a second attachment end 80. The inside surface includes radially extending reverse threads 82 at the first attachment end 78 for mating engagement with the threads 66 on the first restrictor member 56. The outside surface 74 includes radially extending threads 84 at the second attachment end 80. The inside surface 76 defines a second passageway 86 extending longitudinally from the first attachment end 78 to the second attachment end 80. The second passageway 86 is in communication with the first passageway 68 in the first restrictor member 56.

As shown in FIG. 3, the inside surface 76 defines a phase change chamber 90 in the second passageway 86. As described below, the fluid flowing through the valve 50 changes from a liquid to a gas in the chamber 90. The predetermined volume of the chamber 90 determines the phase change of the fluid. The inside surface 76 defines a first restrictor seat 92 and a second restrictor seat 94 adjacent the chamber 90. The phase change chamber member 72 includes a radially extending stop 96 that contacts the second end 64 of the first restrictor member 56 to prevent the forward movement of the member 72 as it is threaded on the member 56. The inside surface 76 also defines a radially extending flange 98.

As shown in FIG. 3, the housing 54 includes a second restrictor member 100 having an outer surface 102, an inner surface 104, a first engagement end 106 and a second engagement end 108. The first engagement end 106 is received by the second attachment end 80 of the phase change chamber member 72. The first engagement end 106 contacts the flange 98 of the phase change chamber member 72 to prevent the forward movement of the second restrictor member 100. The inner surface 104 defines a third passageway 110 that extends longitudinally from the first engagement end 106 to the second engagement end 108. The third passageway 110 decreases in size from the first engagement end 106 to the second engagement end 108. The inner surface 104 can define a second tapered portion 112 in the third passageway 110. A conical fluid filter 114 can be positioned in the third passageway 110 to filter the fluid as it flows through the passageway. The third passageway 110 is in communication with the second passageway 86.

The outer surface 102 of the second restrictor member 100 includes two radially extending grooves 116 and 118. Two 0-rings seals 120 and 122 made of an elastomeric material are positioned in the grooves 116 and 118, respectively, to seal the outer surface 102 and the inside surface 76 of the phase change chamber member 72. The outer surface 102 also defines a radially extending lip 124 that engages the second attachment end 80 of the member 72.

Figure 1:
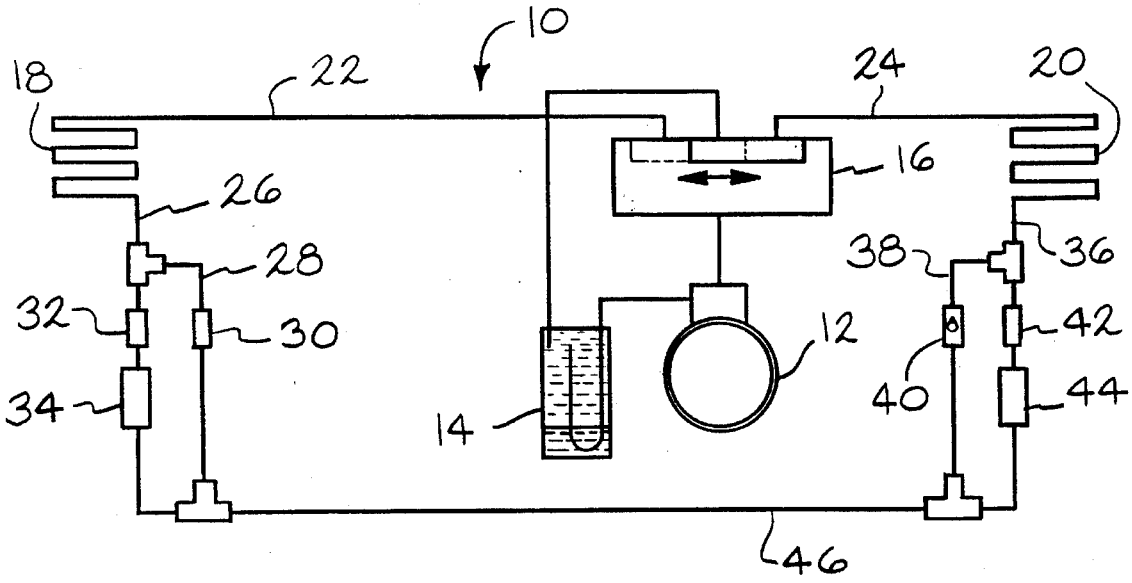
FIG. 1 PRIOR ART
FIG. 1 is a diagrammatic view of a prior art heat pump and air conditioning system.
Figure 2:
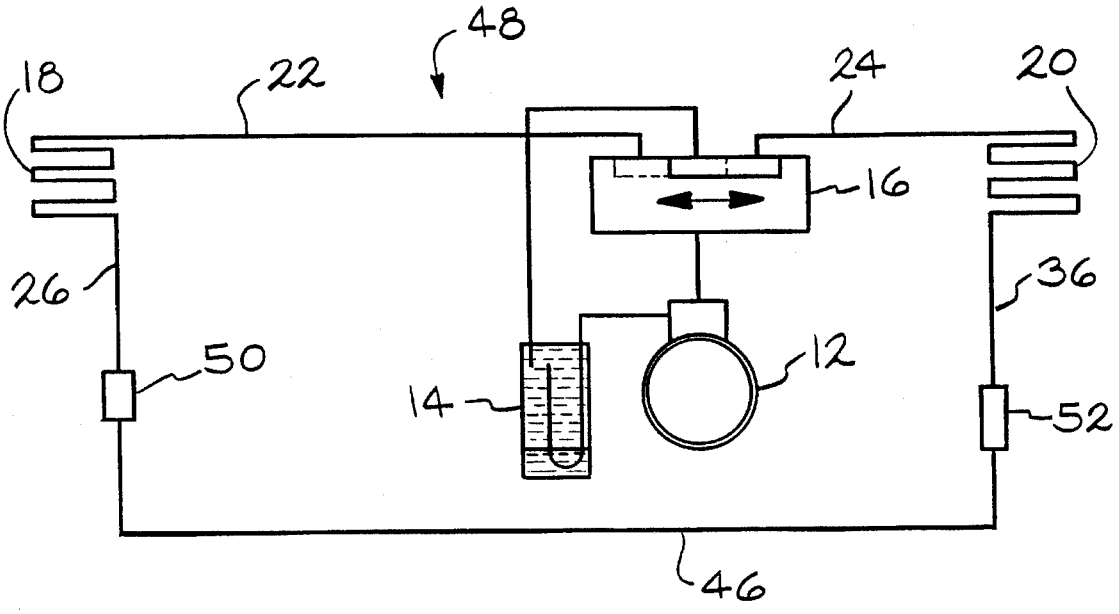
FIG. 2 is a diagrammatic view similar to the view of FIG. 1 showing the inclusion of the present invention.

As shown in FIG. 3, the housing 54 includes a radially extending locking member 130 with a tapered open end 132 having radially extending threads 134. The threads 134 mate with the threads 84 at the second attachment end 80 of the phase change chamber member 72. The locking member 130 maintains the second restrictor member 100 in the second attachment end 80. In the present embodiment, the terminal end 136 of, for example, the first line 26 of a heat pump and air conditioning system as shown in FIG. 2 is positioned between the locking member 130 and the second engagement end 108 of the second restrictor member 100. It should be understood that a variety of fluid conduits can be connected to the valve 50 in many different ways depending on the application. The line 22 includes a passageway 138.

Figure 4:
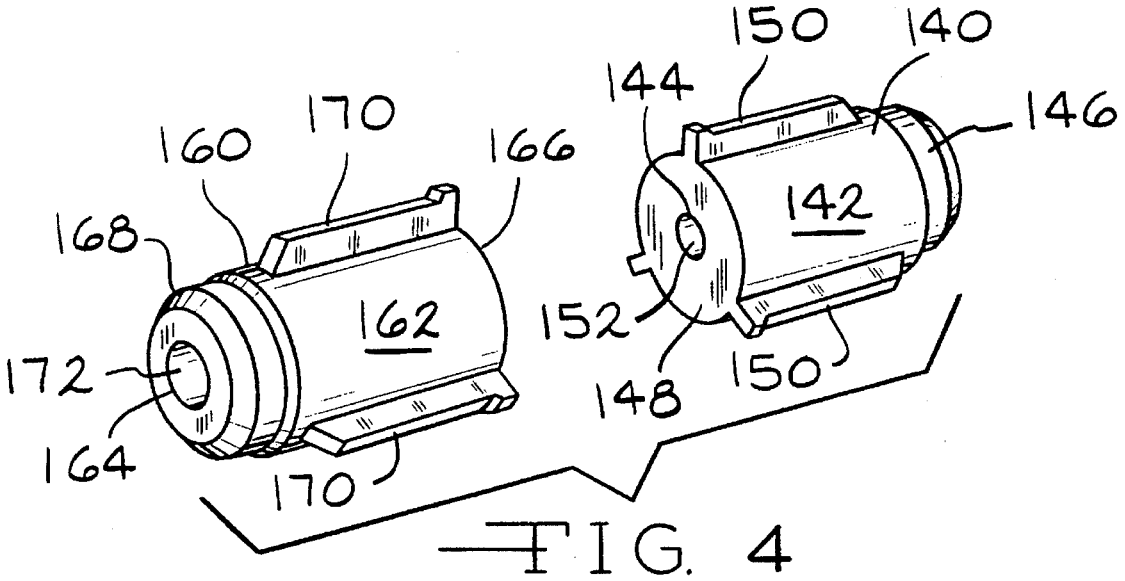
FIG. 4 is a perspective view of the first and second restrictors.
Figure 5:
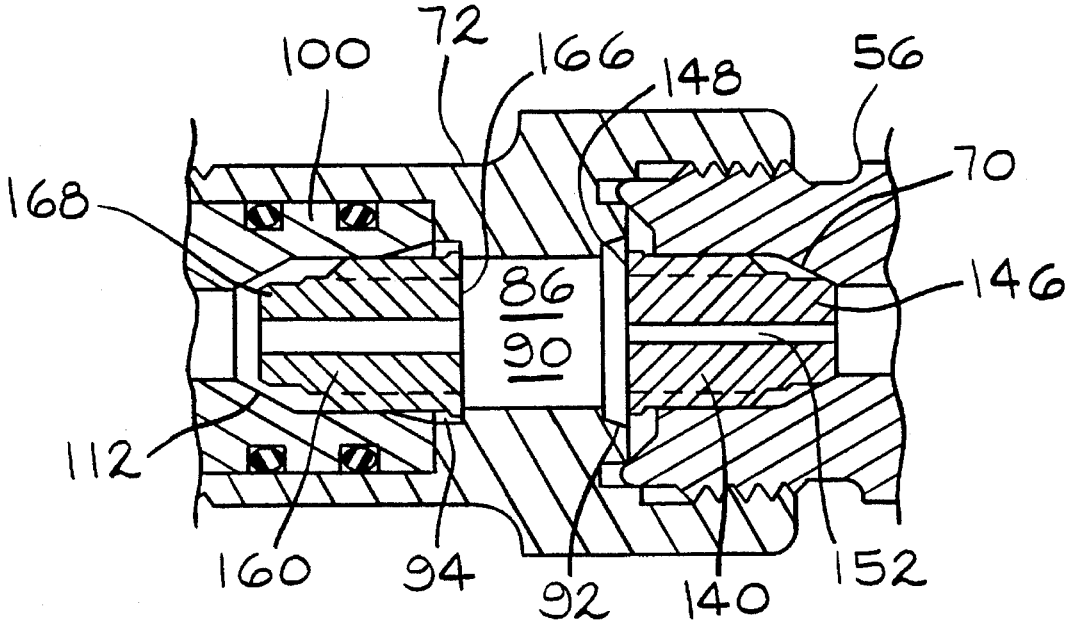
FIG. 5 is a partial cross-sectional view of the present invention showing the first and second restrictors in position for fluid flow in a second direction.

Referring now to FIGS. 3–5, the valve 50 includes a first restrictor 140 having a first restrictor exterior surface 142, a first restrictor interior surface 144, a first restrictor first end 146 and a first restrictor second end 148. The exterior surface 142 defines a contoured surface that corresponds to the shape of the enlarged portion of the first passageway 68 of the first restrictor member 56. As shown in FIG. 4, the first restrictor 140 includes longitudinally extending first projections 150 that are in sliding engagement with the interior surface 60 of the first restrictor member 56. The interior surface 144 defines a first bore 152 that extends longitudinally between the first end 146 and the second end 148. The second end 146 defines a surface that corresponds to the shape of the first restrictor seat 92 of the phase change chamber member 72. The first restrictor 140 is movably mounted in the first passageway 68 adjacent the phase change chamber 90. The movement of the first restrictor 140 is constrained in the longitudinal direction by contact of the first end 146 with the first tapered portion 70 and contact of the second end 148 with the seat 92.

Still referring to FIGS. 3–5, the valve 50 includes a second restrictor 160 having a second restrictor exterior surface 162, a second restrictor interior surface 164, a second restrictor first end 166 and a second restrictor second end 168. As shown in FIGS. 3–5, the second restrictor 160 includes second projections 170, a second bore 172 and is shaped and positioned in passageway 110 as described above for the first restrictor 140. When positioned in the passageway 110, the second restrictor 160 is adjacent the phase change chamber 90 in an opposed reciprocal relationship to the first restrictor 140.

Figure 7:
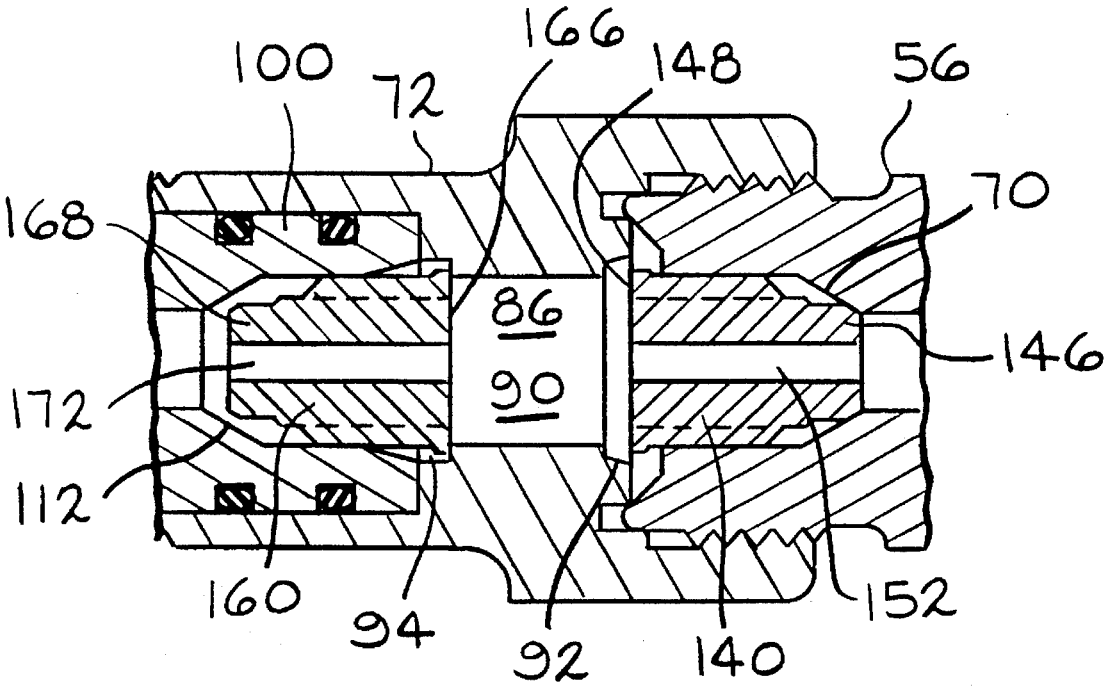
FIG. 7 is a view similar to the view of FIG. 5 showing the first bore in the first restrictor and the second bore in second restrictor having equal diameters.

As shown in FIGS. 3–5, the first bore 152 of the first restrictor 140 and the second bore 172 of the second restrictor 160 have predetermined sizes. The total volume of the first bore 152 is less than the total volume of the phase change chamber 90. Similarly, the total volume of the second bore 172 is less than the total volume of the phase change chamber 90. The bores must be of sufficient size to compress the liquid fluid to a certain pressure that upon exit from the bores and entrance to the phase change chamber 90, the decrease in pressure on the liquid fluid causes it to form a gas. The predetermined size of the bores is also important in the metering of the fluid through the passageway. The size of each bore can be varied depending on the type of system to which the present invention is attached, including the type of liquid refrigerant being utilized in the system. The size of the bores will determine the amount of the fluid that can pass through the space provided. As shown in FIG. 7, the first bore 152 and the second bore 172 can have equal diameters and therefore equal sizes. The bores can also have different diameters and therefore different sizes depending on the application.

Figure 6:
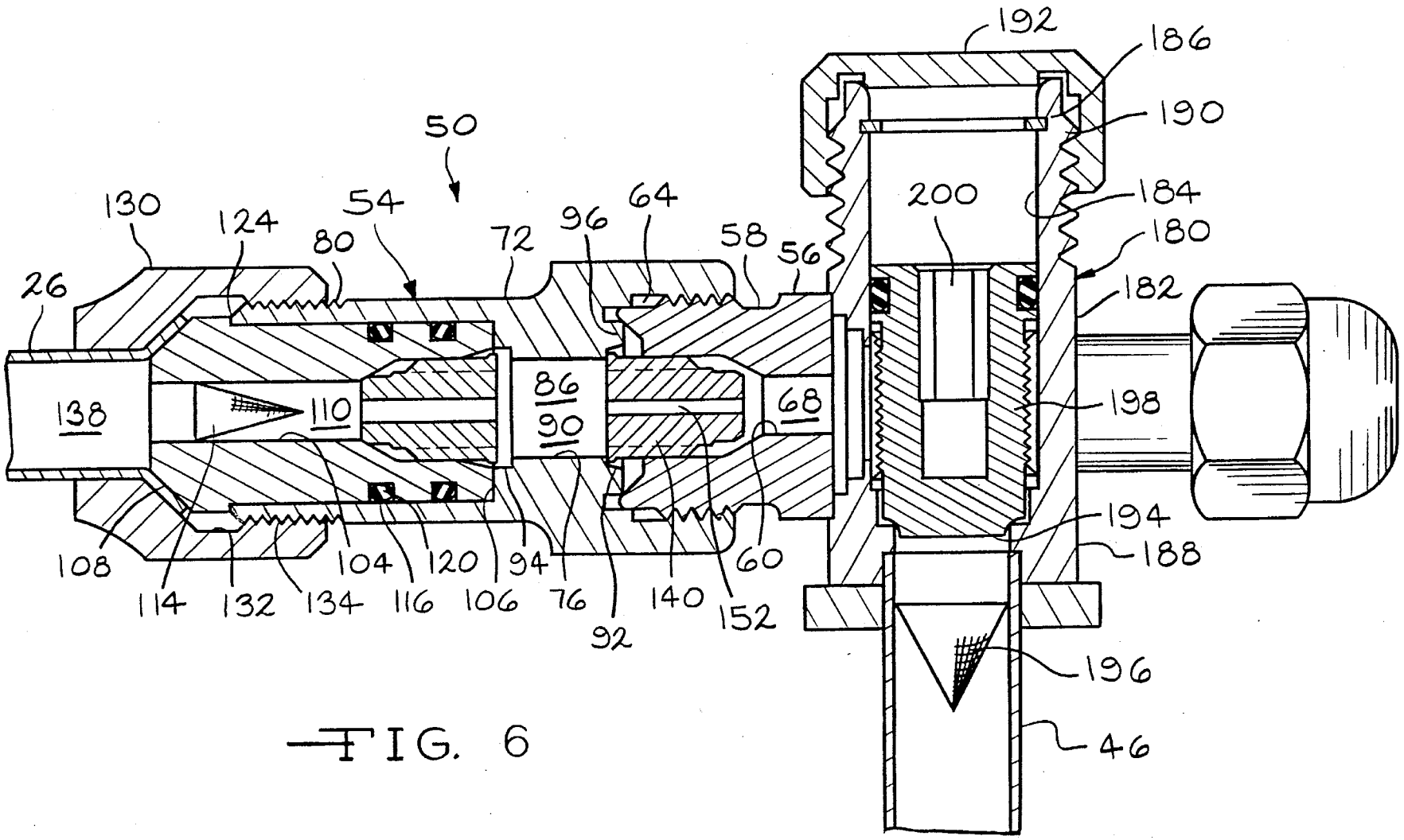
FIG. 6 is a cross-sectional view similar to the view of FIG. 3 showing the threaded opening and threaded plunger in a closed position.

As shown in FIGS. 3 and 6, the valve 50 includes a fluid flow regulation member 180 adjacent the housing 54. The member 180 includes a regulation member exterior surface 182, a regulation member interior surface 184, a regulation member first end 186 and a regulation member second end 188. The exterior surface 182 defines a radially extending threaded portion 190 at the first end 186. A threaded cap 192 mates with the threaded portion 190. The cap 192 can be removed to provide access to the interior of the member 180. The interior surface 184 defines a threaded opening 194 that is in communication with the first passageway 68 and, for example, line 46 of the heat pump and air conditioning system 48 as shown in FIG. 2. A conical fluid filter 196 can be positioned in the line 46. A threaded plunger 198 is mounted in the member 180. The plunger 198 can be rotated and thereby moved in the threaded opening 194 by use of a wrench (not shown) that can be inserted in a wrench opening 200 in the top of the plunger 198. Access to the opening 200 is gained by removing the cap 192. The plunger 198 is movable from an open position, as shown in FIG. 3, to a closed position, as shown in FIG. 6. When the plunger 198 is in a closed position, fluid is prevented from flowing from line 46 through the member 180 to the first passageway 68. The plunger 198 can be used to prevent fluid flow during, for example, maintenance and repair of the valve 50 or the system to which the valve is attached.

Referring to FIGS. 2–6, the operation of the valve 50 will now be described. When the plunger 198 is in an open position, as shown in FIG. 3, a fluid, such as a liquid refrigerant, flows from line 46 past filter 196 through opening 194 and into the first passageway 68 of the first restrictor member 56. An example of a liquid refrigerant is a halogenated hydrocarbon. As shown in FIG. 3, the first restrictor 140 and the second restrictor 160 are in a first position. The second end 148 of the first restrictor 140 is in contact with the first restrictor seat 92. This contact prevents the flow of fluid around the exterior surface 142 of the first restrictor 140. Therefore, fluid can only flow through the first bore 152 into the phase change chamber 90. When the second restrictor 160 is in its first position, the second end 168 is in contact with the second tapered portion 112. This position allows a fluid in a gas phase to flow around the exterior surface 162 and through the second bore 172 of the second restrictor 160.

As the liquid fluid enters the first bore 152 it becomes compressed due to the relatively small volume of the bore. When the compressed fluid enters the phase change chamber 90, the liquid fluid changes phase to a gaseous fluid because of the increased volume of the chamber that results in a drop in pressure on the liquid fluid. The liquid fluid atomizes into discrete particles to form the gaseous fluid. Each particle has a diameter in the range of from about 5 to about 200 microns. The gas then flows through and around the second restrictor 160 through the third passageway 110 to line 26.

As shown in FIG. 2, the flow of fluid through the system 48 can be reversed by actuating reversing valve 16. This causes the liquid refrigerant to flow in the opposite direction through the valve 50. As shown in FIG. 5, the first restrictor 140 and the second restrictor 160 are moved from the first position, as shown in FIG. 3, to a second position. In the second position, the liquid refrigerant flows from line 26 through second bore 172 into the phase change chamber 90 where it becomes a gas. The gas then travels through the first bore 152 and around the exterior surface 142 of the first restrictor 140 through the first passageway 68 and opening 194 to line 46.

It should be understood that many changes can be made to the embodiment of the invention as described above without departing from the scope of the appended claims.

I claim:

1. An integral bi-directional flow control valve comprising:

a housing defining a fluid passageway for the flow of a fluid in a first direction and a second direction, said housing defining a phase change chamber in said fluid passageway, said housing including a first restrictor member having an exterior surface, an interior surface, a first end and a second end, said exterior surface including threads at said second end, said interior surface defining a first passageway extending from said first end to said second end, said first passageway increasing in size from said first end to said second end;

a first restrictor having a first bore positioned in said first passageway adjacent said chamber, said first bore having a volume less than the volume of said chamber, said first bore regulating said flow of said fluid through said first passageway, said fluid changing from a liquid to a gas as said fluid flows through said first bore and said chamber in said first direction; and a second restrictor having a second bore positioned in said fluid passageway adjacent said chamber opposed to said first restrictor, said second bore having a volume less than the volume of said chamber, said second bore regulating said flow of said fluid through said fluid passageway, said fluid changing from a liquid to a gas as said fluid flows through said second bore and said chamber in said second direction.

2. An integral bi-directional flow control valve comprising:

a housing defining a fluid passageway for the flow of a fluid in a first direction and a second direction, said housing defining a phase change chamber in said fluid passageway, said housing including a first restrictor member having an exterior surface, an interior surface, a first end and a second end, said exterior surface including attachment means at said second end, said interior surface defining a first passageway extending from said first end to said second end, said first passageway increasing in size from said first end to said second end, said housing further including a phase change chamber member having an outside surface, an inside surface, a first attachment end and a second attachment end, said inside surface including attachment means at said first attachment end for mating engagement with said attachment means at said second end of said first restrictor member, said outside surface including attachment means at said second attachment end, said inside surface defining a second passageway extending from said first attachment end to said second attachment end, said second passageway being in communication with said first passageway in said first restrictor member;

a first restrictor having a first bore positioned in said first passageway adjacent said chamber, said first bore having a volume less than the volume of said chamber, said first bore regulating said flow of said fluid through said first passageway, said fluid changing from a liquid to a gas as said fluid flows through said first bore and said chamber in said first direction; and a second restrictor having a second bore positioned in said fluid passageway adjacent said chamber opposed to said first restrictor, said second bore having a volume less than the volume of said chamber, said second bore regulating said flow of said fluid through said fluid passageway, said fluid changing from a liquid to a gas as said fluid flows through said second bore and said chamber in said second direction.

3. An integral bi-directional flow control valve comprising:

a housing defining a fluid passageway for the flow of a fluid in a first direction and a second direction, said housing defining a phase change chamber in said fluid passageway, said housing including a first restrictor member having an exterior surface, an interior surface, a first end and a second end, said exterior surface including attachment means at said second end, said interior surface defining a first passageway extending from said first end to said second end, said first passageway increasing in size from said first end to said second end, said housing further including a phase change chamber member having an outside surface, an inside surface, a first attachment end and a second attachment end, said inside surface including attachment means at said first attachment end for mating engagement with said attachment means at said second end of said first restrictor member, said outside surface including attachment means at said second attachment end, said inside surface defining a second passageway extending from said first attachment end to said second attachment end, said second passageway being in communication with said first passageway in said first restrictor member, said housing further including a second restrictor member having an outer surface, an inner surface, a first engagement end and a second engagement end, said first engagement end being received by said second attachment end of said phase change chamber member, said inner surface defining a third passageway extending from said first engagement end to said second engagement end, said third passageway decreasing in size from said first engagement end to said second engagement end, said third passageway in communication with said second passageway of said phase change chamber member;

a first restrictor having a first bore positioned in said first passageway adjacent said chamber, said first bore having a volume less than the volume of said chamber, said first bore regulating said flow of said fluid through said first passageway, said fluid changing from a liquid to a gas as said fluid flows through said first bore and said chamber in said first direction; and a second restrictor having a second bore positioned in said third passageway adjacent said chamber opposed to said first restrictor, said second bore having a volume less than the volume of said chamber, said second bore regulating said flow of said fluid through said third passageway, said fluid changing from a liquid to a gas as said fluid flows through said second bore and said chamber in said second direction.

4. The flow control valve of claim 3, wherein said outer surface of said second restrictor member includes at least one radially extending groove and at least one O-ring seal positioned in said groove.

5. The flow control value of claim 3, wherein said third passageway contains a fluid filter.

6. The flow control value of claim 3, wherein said housing includes a radially extending locking member having a tapered open end, said end including attachment means for mating engagement with said attachment means at said second attachment end of said phase change chamber member, said locking member engaging said second engagement end of said second restrictor member.

7. An integral bi-directional flow control valve comprising:

a housing defining a passageway for the flow of a fluid in a first direction and a second direction, said housing defining a phase change chamber in said passageway;

a fluid flow regulation member having an opening in communication with said passageway and a movable plunger adjacent said opening, said plunger being movable from an open position to a closed position to regulate the flow of fluid through said opening to or from said passageway;

a first restrictor having a first bore positioned in said passageway adjacent said chamber, said first bore having a volume less than the volume of said chamber, said first bore regulating said flow of said fluid through said passageway, said fluid changing from a liquid to a gas as said fluid flows through said first bore and said chamber in said first direction; and a second restrictor having a second bore positioned in said passageway adjacent said chamber opposed to said first restrictor, said second bore having a volume less than the volume of said chamber, said second bore regulating said flow of said fluid through said passageway, said fluid changing from a liquid to a gas as said fluid flows through said second bore and said chamber in said second direction.

8. The flow control valve claim 7, wherein a fluid filter is positioned adjacent said opening.

9. The flow control valve of claim 7, wherein said first restrictor is movable from a first position to a second position.

10. The flow control valve of claim 7, wherein said second restrictor is movable from a first position to a second position.

11. The flow control valve of claim 7, wherein said first restrictor is reciprocal with said second restrictor.

12. The flow control valve of claim 7, wherein said first bore of said first restrictor and said second bore of said second restrictor have equal diameters.

13. The flow control valve of claim 7, wherein said first bore of said first restrictor has a diameter different than the diameter of said second bore of said second restrictor.

* * * * *